US008629744B2

(12) United States Patent
Prohaska et al.

(10) Patent No.: US 8,629,744 B2
(45) Date of Patent: Jan. 14, 2014

(54) ENCLOSED SWITCH INCLUDING A SHUNT TRIP MECHANISM

(75) Inventors: Richard D. Prohaska, Cleveland, TN (US); Jeffrey B. Ensley, Cleveland, TN (US)

(73) Assignee: Eaton Corporation, Cleveland, OH (US)

( * ) Notice: Subject to any disclaimer, the term of this patent is extended or adjusted under 35 U.S.C. 154(b) by 9 days.

(21) Appl. No.: 13/402,152

(22) Filed: Feb. 22, 2012

(65) Prior Publication Data

US 2013/0214885 A1 Aug. 22, 2013

(51) Int. Cl.
*H01H 9/00* (2006.01)

(52) U.S. Cl.
USPC ..... 335/172; 335/16

(58) Field of Classification Search
USPC ..... 335/172–176, 16; 200/1, 7, 14, 48, 49, 200/57, 65, 78, 84, 92, 118, 120, 140, 154
See application file for complete search history.

(56) References Cited

U.S. PATENT DOCUMENTS

| | | | | |
|---|---|---|---|---|
| 2,561,985 A * | 7/1951 | Jones et al. | ..... | 361/84 |
| 3,495,198 A * | 2/1970 | Giger, Jr. | ..... | 335/16 |
| 3,588,761 A * | 6/1971 | Heft | ..... | 335/16 |
| 5,408,208 A * | 4/1995 | DiMarco et al. | ..... | 335/14 |

* cited by examiner

*Primary Examiner* — Bernard Rojas
(74) *Attorney, Agent, or Firm* — Eckert Seamans Cherin & Mellott, LLC; Kirk D. Houser

(57) ABSTRACT

An enclosed switch includes a switch assembly having separable contacts; an operating mechanism structured to open and close the separable contacts; and a shunt trip mechanism cooperating with the operating mechanism to trip open the separable contacts, wherein the operating mechanism includes a manual operating mechanism.

16 Claims, 10 Drawing Sheets

ENCLOSED SWITCH INCLUDING A SHUNT TRIP MECHANISM

BACKGROUND

1. Field

The disclosed concept pertains generally to enclosed switches and, more particularly, to enclosed switches, such as, for example, dead-front switches, safety switches and disconnects.

2. Background Information

Enclosed and dead-front switches are defined by UL Standard 98. These include individually enclosed air switches, rated 4000 A or less at 600 V or less, having all current-carrying parts enclosed, and manually operable by means of external handles.

There is room for improvement in electrical switching apparatus, such as enclosed switches.

SUMMARY

These needs and others are met by embodiments of the disclosed concept, which provides an enclosed switch including a shunt trip mechanism. As a result, a manually operated enclosed switch can be tripped open by an external signal.

In accordance with embodiments of the disclosed concept, an enclosed switch comprises: a switch assembly comprising separable contacts; an operating mechanism structured to open and close the separable contacts; and a shunt trip mechanism cooperating with the operating mechanism to trip open the separable contacts, wherein the operating mechanism comprises a manual operating mechanism.

The shunt trip mechanism may be structured to operate and engage the operating mechanism only when the manual operating mechanism is in a closed position.

The manual operating mechanism may comprise a manual operating handle; the shunt trip mechanism may further comprise a pawl lever; a latch lever, when released, may cause rotation of the pawl lever to disengage the manual operating handle from the manual operating mechanism; and the manual operating handle moves to an intermediate position between a closed position and an open position thereof in response to release of the latch lever.

The manual operating mechanism may comprise a pair of wheels normally coupled together by a coupling member mounted to one of the wheels and an opening in the other one of the wheels; the manual operating handle may be rotatably coupled to the one of the wheels; and rotation of the pawl lever may cause the other one of the wheels to decouple from the one of the wheels, thereby allowing the manual operating handle to move to the intermediate position.

The shunt trip mechanism may comprise a trip shaft; the operating mechanism may comprise a first pair of wheels normally coupled together by a plurality of coupling members of the wheels; a first one of the first pair of wheels may comprise a latch arm normally held by the trip shaft; rotation of the trip shaft may release the latch arm of the first one of the first pair of wheels; the first one of the first pair of wheels may be biased to cause rotation of a second one of the first pair of wheels to an off position thereof, in order to open the separable contacts; the manual operating mechanism may comprise a second pair of wheels normally coupled together by a pawl lever coupled to one of the second pair of wheels and an opening in the other one of the second pair of wheels; the manual operating handle may be rotatably coupled to the one of the second pair of wheels; the shunt trip mechanism may further comprise a pawl lever to disengage the manual operating handle from the manual operating mechanism; the manual operating handle may move to an intermediate position between a closed position and an open position thereof in response to the pawl lever causing the other one of the second pair of wheels to decouple from the one of the second pair of wheels, thereby allowing the manual operating handle to move to the intermediate position.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "enclosed switch" shall mean a switch defined by UL Standard 98. Such an enclosed switch is also commonly referred to as a dead-front switch, a safety switch or a disconnect (switch).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

Referring to FIGS. 1-6, the disclosed shunt trip mechanism 100 (FIG. 4) enables an enclosed switch 102 (FIG. 3) of an operating mechanism, such as a side mounted mechanism 104, to be relatively quickly opened with a momentary electrical signal (not shown). The side mounted mechanism 104 is manually reset upon a subsequent manual operation to an "off" (or open) position (FIG. 5) and then to an "on" (or closed) position (FIG. 6) to close separable contacts 106 (FIG. 6) of the enclosed switch 102.

Figure 1:
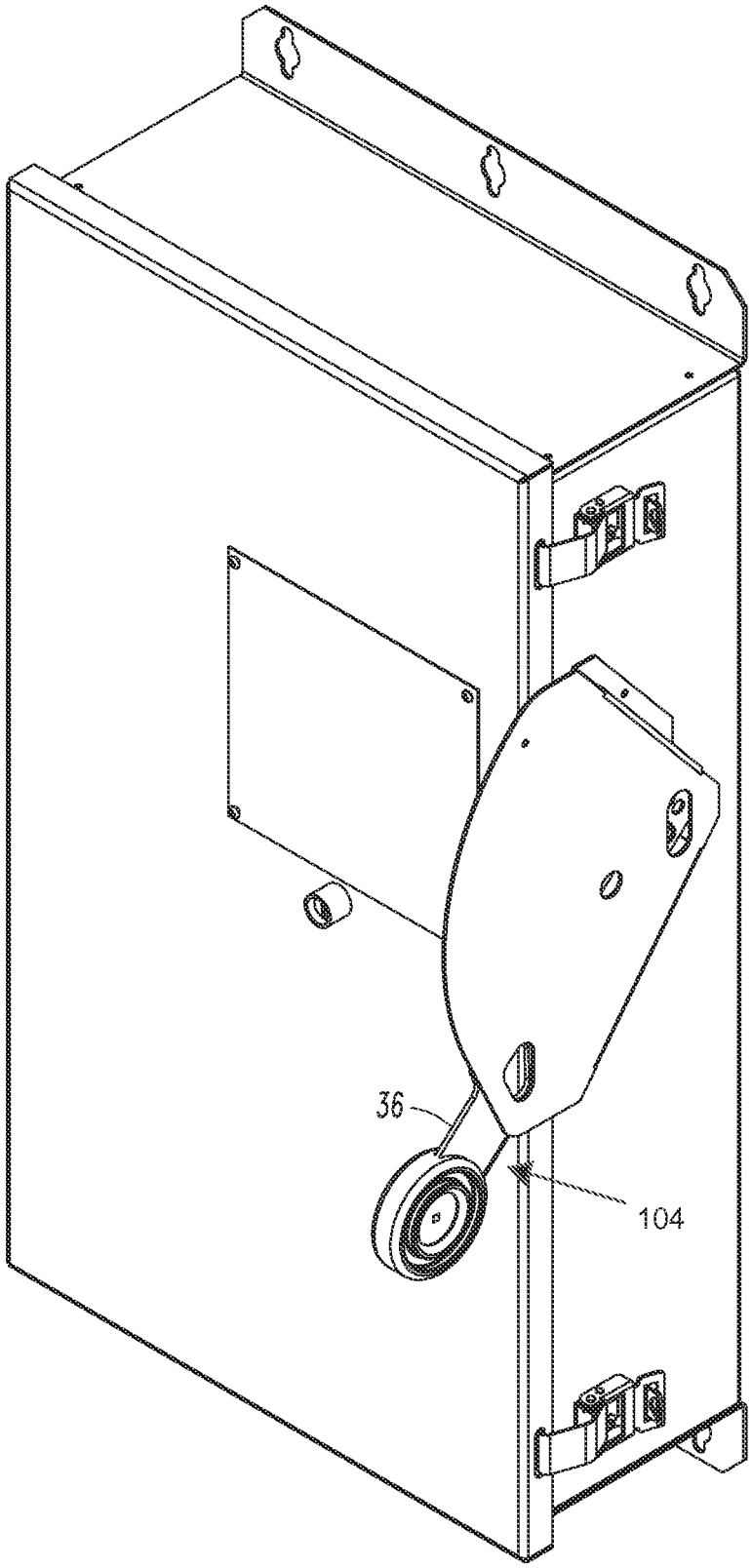
FIG. 1 is an isometric view of an enclosed or dead-front switch in accordance with embodiments of the disclosed concept.
Figure 2:
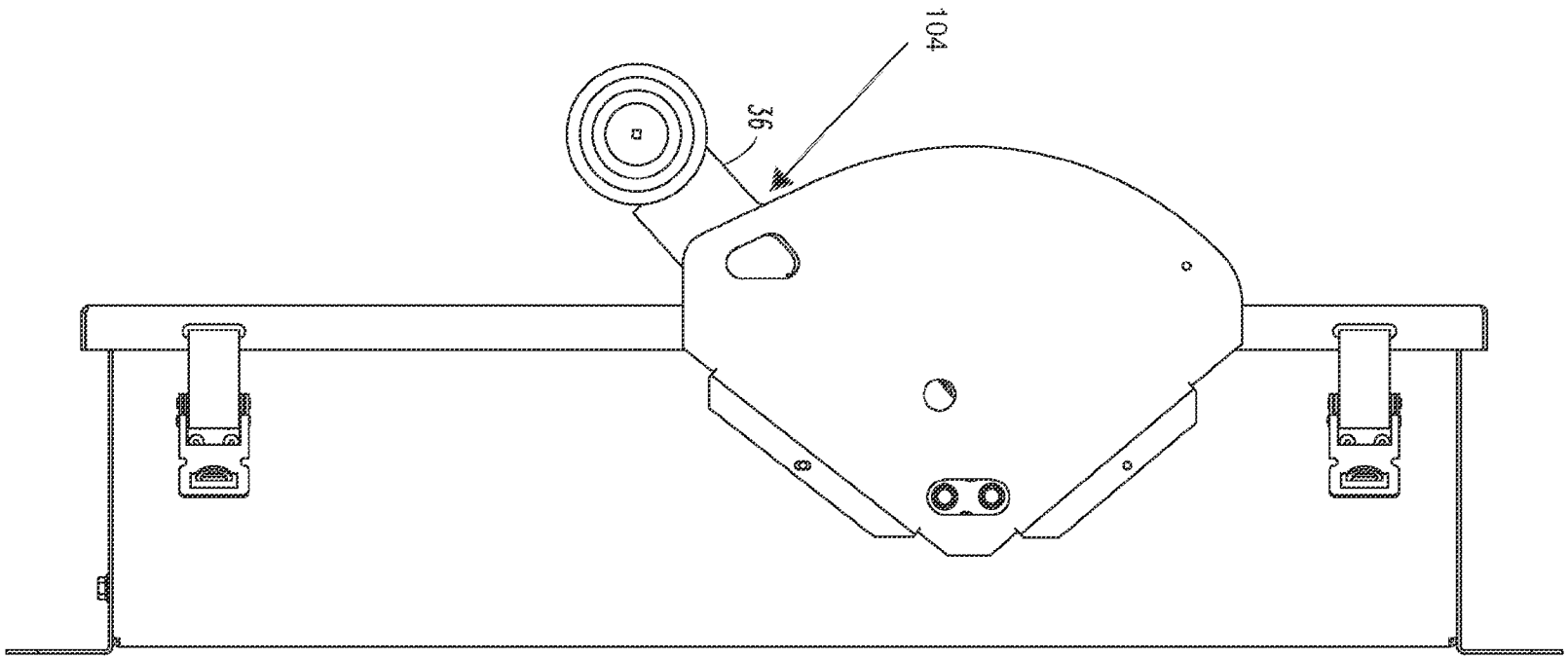
FIG. 2 is a side vertical elevation view of the switch of FIG. 1.
Figure 3:
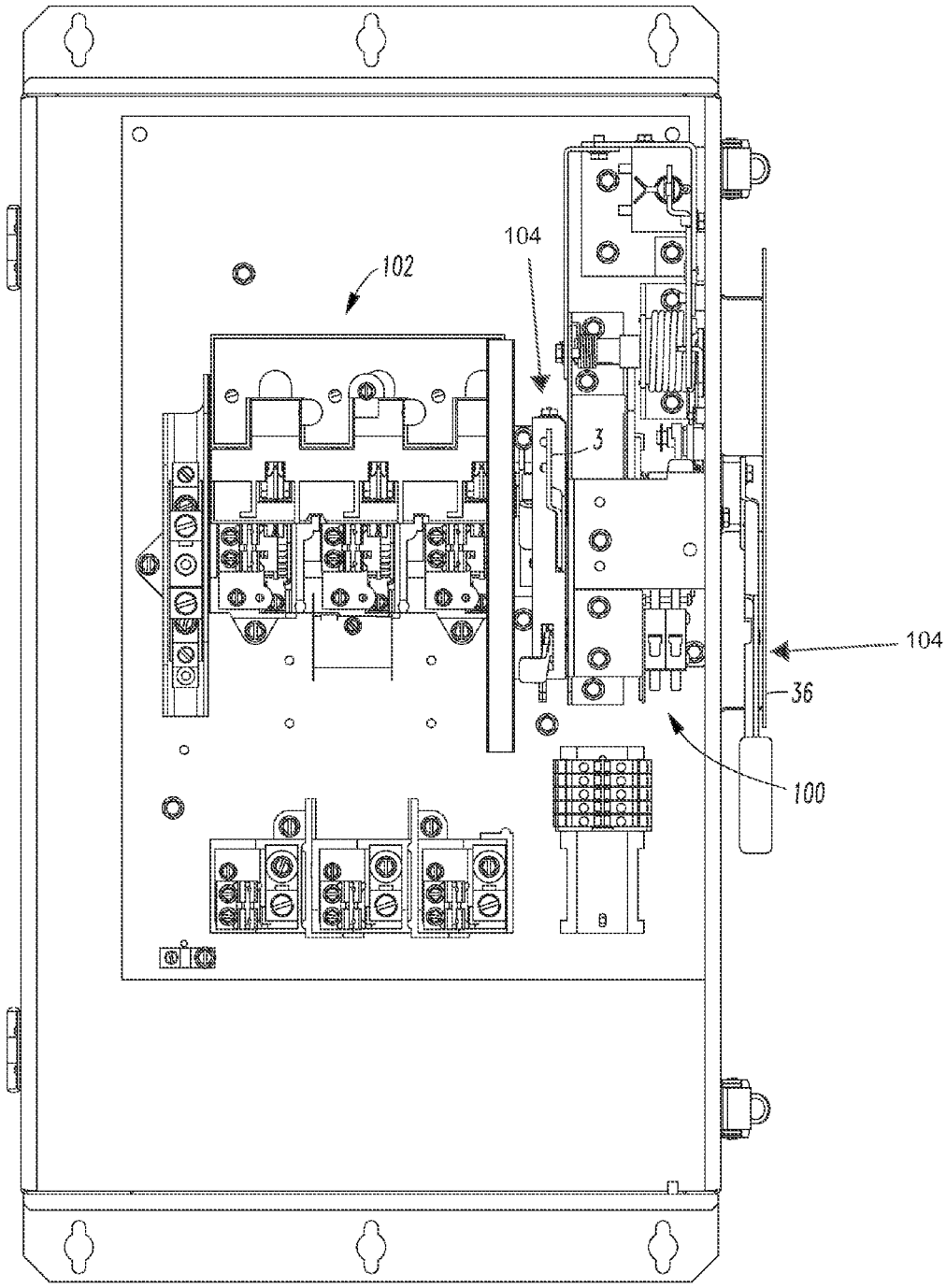
FIG. 3 is a vertical elevation view of the switch of FIG. 1 with the front cover removed to show internal structures.
Figure 4:
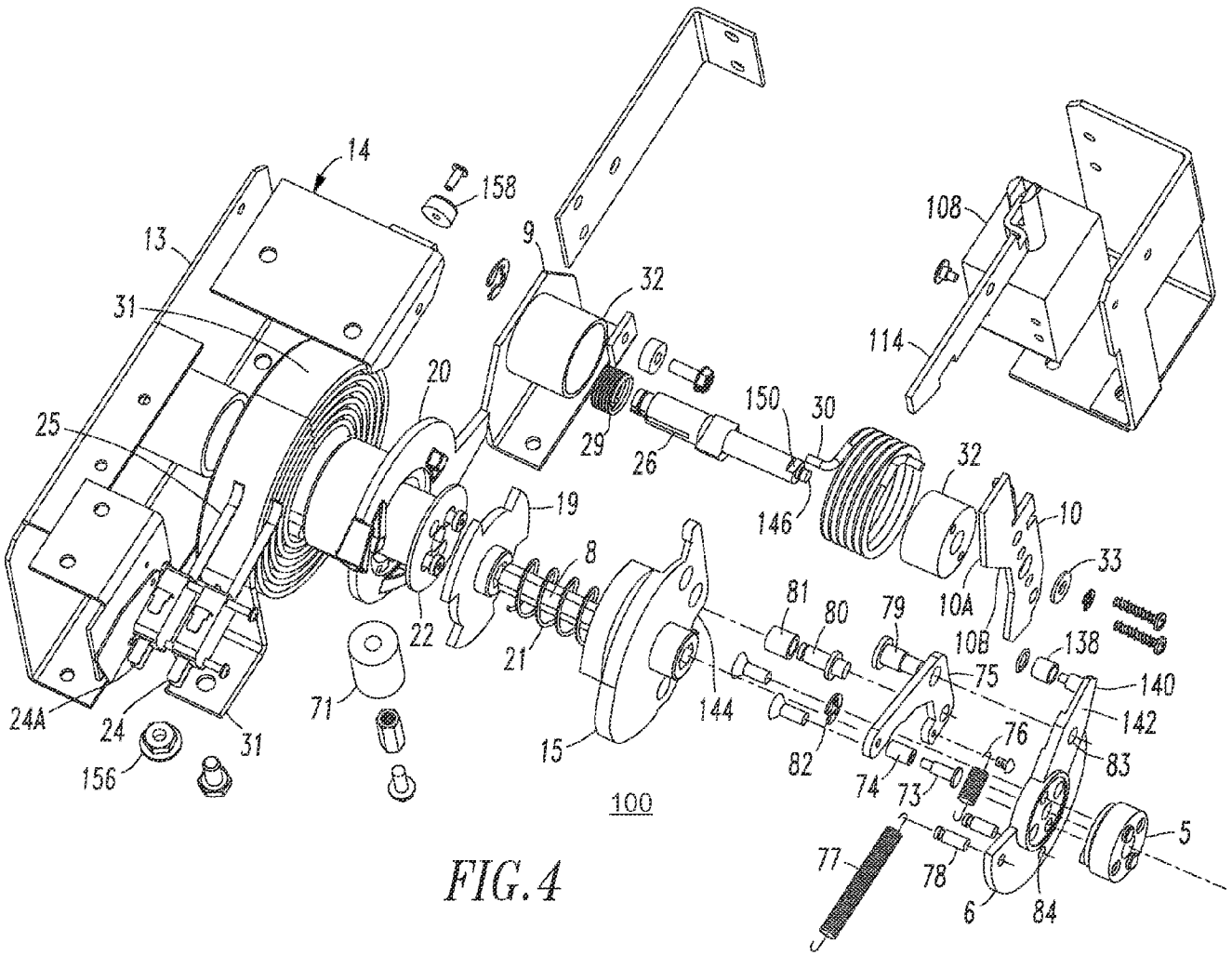
FIG. 4 is an exploded isometric view of the shunt trip mechanism of the switch of FIG. 1.
Figure 6:
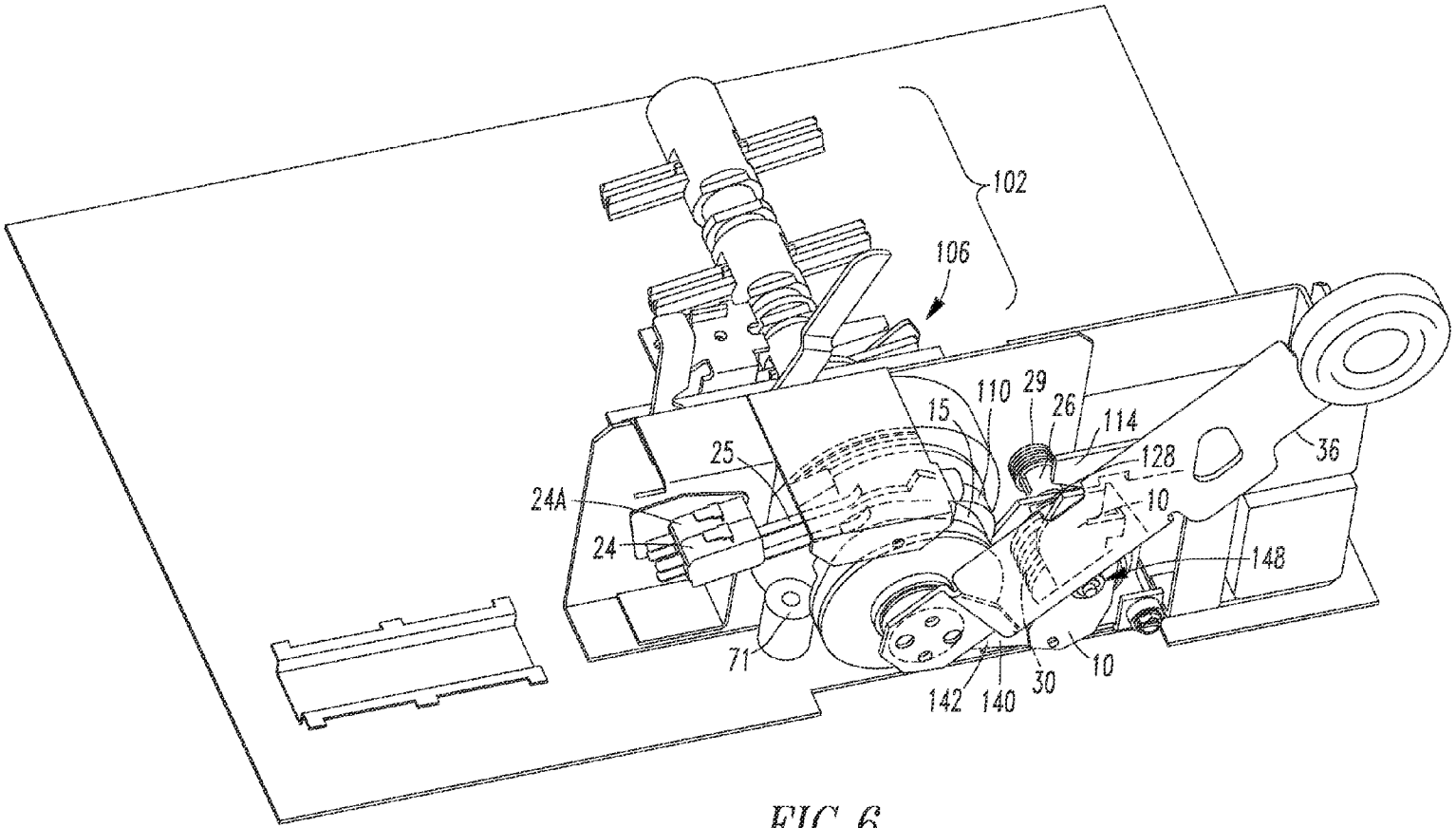
FIG. 6 is an isometric view of the shunt trip mechanism of FIG. 4 in the opening spring charged position and the switch in the on position.
Figure 7:
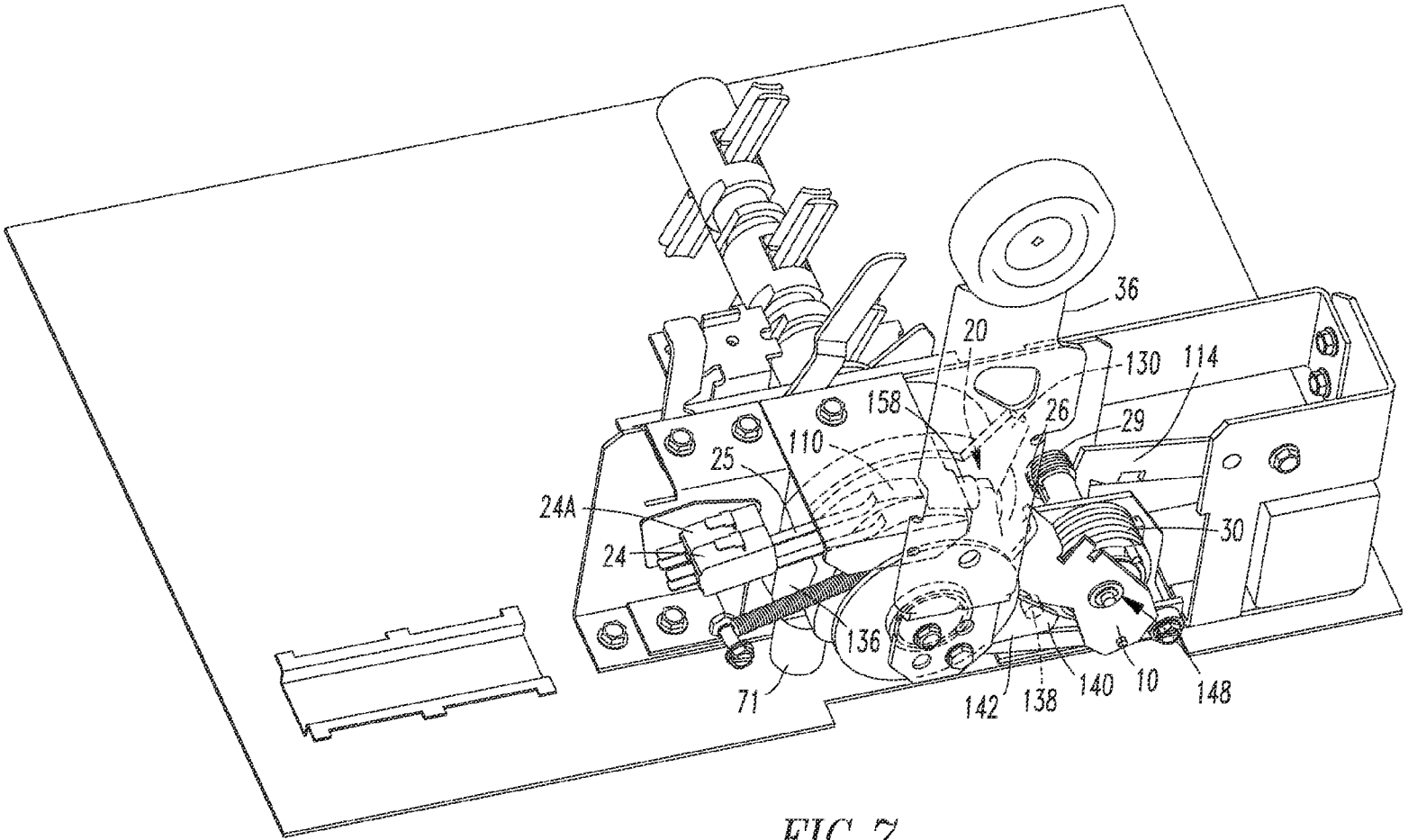
FIG. 7 is an isometric view of the shunt trip mechanism of FIG. 4 in the discharged position with the switch open.

The side mounted mechanism 104 employs stored mechanical energy to trip open the switch separable contacts 106, when using a manual operating mechanism 3 of a main switch assembly 38 (FIG. 3). During normal, non-automatic opening of the enclosed switch 102, normal manual operation with an operating handle 36 bypasses the shunt trip mechanism 100. The shunt trip mechanism 100 is structured to operate and engage only when the manual operating mechanism 3 is in the "on" (or closed) position (FIG. 6). When the manual operating mechanism 3 is in the closed position, a solenoid 108 of the shunt trip mechanism 100 is enabled with contacts (not shown) of micro-switch 24A being closed when its arm 25 is not engaged by cam surface 110 (FIG. 4) of wheel three 15 as shown in FIGS. 4 and 6. Conversely, the solenoid 108 is disabled with contacts (not shown) of micro-switch 24A being open when its arm 25 is engaged by cam surface 110 of wheel three 15 as shown in FIG. 7.

When current flows in the solenoid 108 with micro-switch 24A closed, the solenoid plunger 112 is pulled in. This rotates clockwise (with respect to FIGS. 4, 6 and 7) trigger lever latch 114 that, in turn, releases a trip latch lever 10 (as shown in FIG. 7). The trip latch lever 10 performs two actions in tandem with energy stored in a latch shaft drive spring 30 that biases the lever 10 at one end and is fixed at its other end at an opening (not shown) in trip shaft bracket 9 (FIG. 4). These two actions include: (1) rotation of the pawl lever 75; and (2) rotation (counter-clockwise with respect to FIGS. 4, 6 and 7) of the trip shaft 26.

Rotation of the bushing shaft 73 of actuator bushing 74 of the pawl lever 75 is made with edge 10A of the trip latch lever 10. At this actuation of the pawl lever 75, the pawl bushing 81 of pawl bushing shaft 80 exits opening, such as slot 144, in wheel three 15, causing coupling to be lost between wheel three 15 and wheel four 6. This releases operating handle coupling 5 and allows the manual operating handle 36 to move to an intermediate position (FIG. 7) indicating that the switch 102 is in a tripped state. The movement of the manual operating handle 36 to the intermediate position is facilitated by extension spring 77 and extension spring anchor 78 of wheel four 6. The pawl lever 75 is pivotally coupled to the wheel four 6 at opening 83 by pawl lever bearing shaft 79. Return bias (clockwise with respect to FIG. 4) for the pawl lever 75 is provided by pawl lever return spring 76, which is coupled to another opening 84 of wheel four 6.

Figure 10:
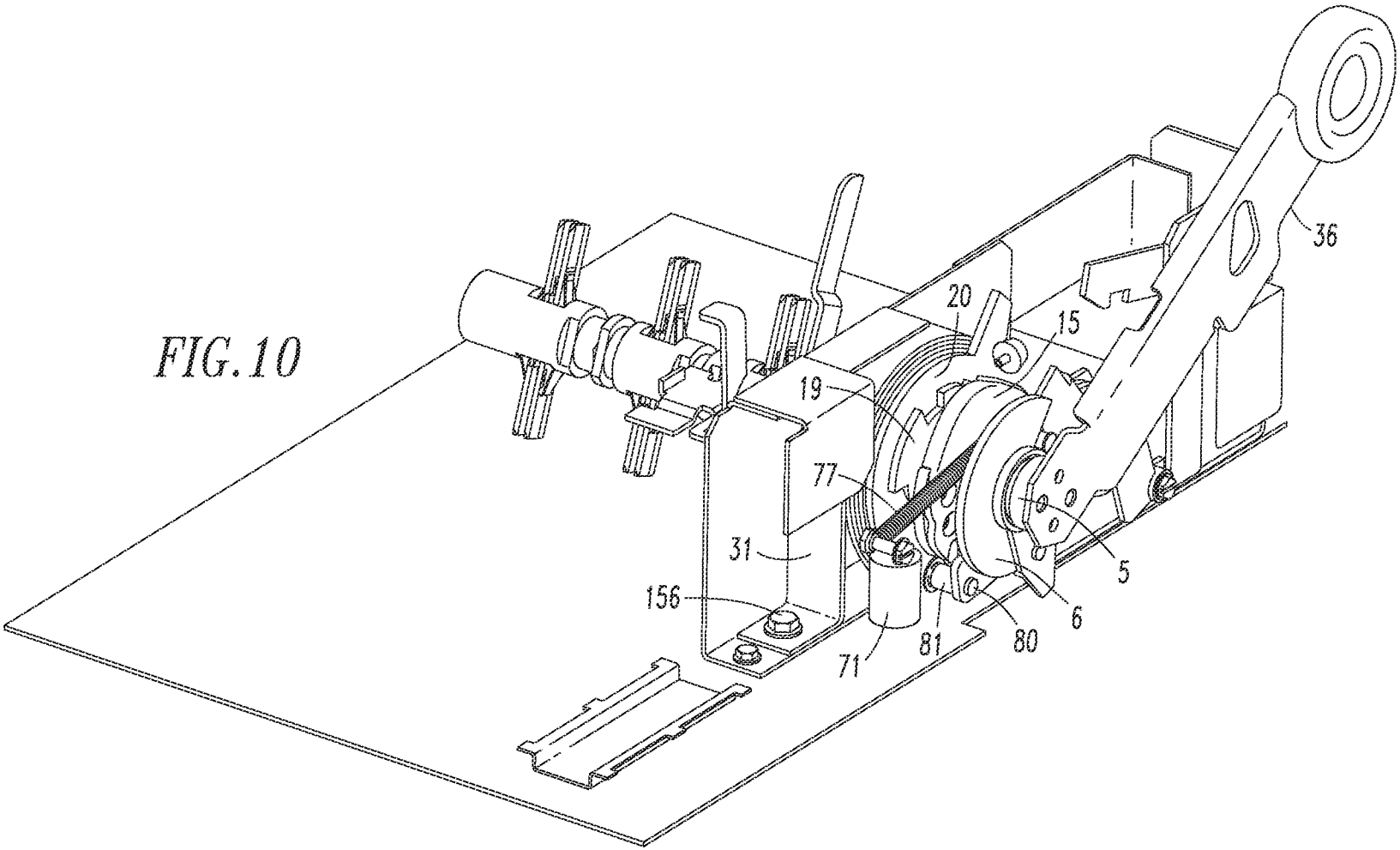
FIG. 10 is an isometric view of the shunt trip mechanism of FIG. 4 in the tripped position showing the pawl lever disengaged position, switch opened by shunt trip.

During actuation of the pawl lever 75 (FIG. 10), this disengages pawl lever 75 bushing 81 and shaft 80 coupling wheel three 15 and wheel four 6, thereby releasing the handle coupling 5 to allow the operating handle 36 to move to an intermediate position (FIG. 7) in response to the trip latch lever 10 and the corresponding spring 30, in order to indicate that the enclosed switch 102 is in a tripped state. Rotation of the trip shaft 26 causes the latch arm 130 of wheel one 20 to pass through center 146 of the trip shaft 26 and the latch arm 130 is released by the flat 128 of the trip shaft 26.

Wheel four 6 is coupled to operating handle coupling 5 upon which the operating handle 36 (FIGS. 1-3) is coupled. Wheel four 6 has a bearing socket 124 for a round end 126 (FIG. 8) of a hexagonal shaft 8 (FIG. 4). The hexagonal shaft 8 engages corresponding openings of the manual mechanism coupling 22, wheel two 19 and wheel three 15 for rotation therewith. The manual mechanism coupling 22 is fastened to the manual operating mechanism 3 for rotation therewith. Rotation of the trip shaft 26 and the flat 128 thereof then releases latch arm 130 of wheel one 20.

Figure 8:
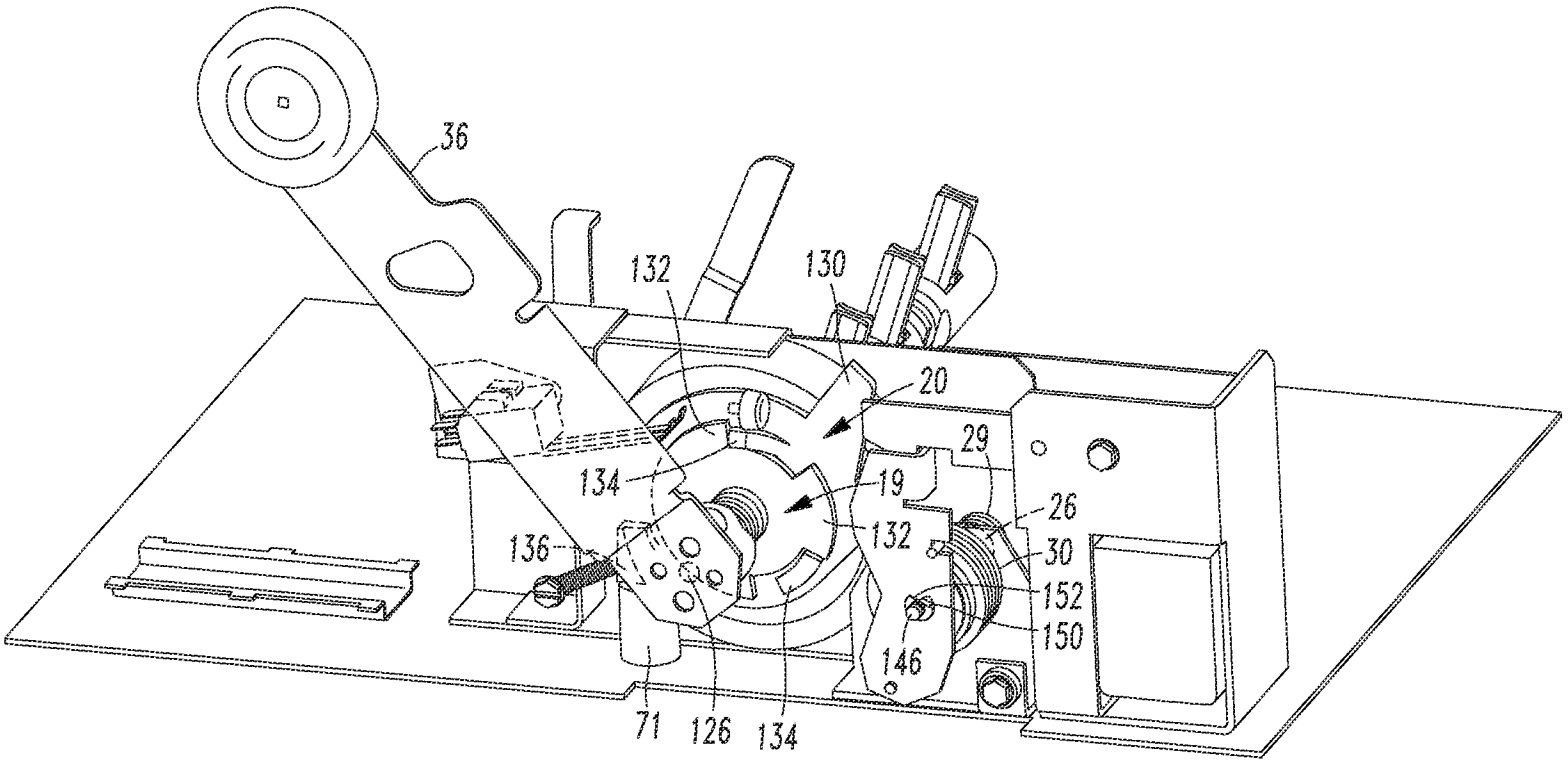
FIG. 8 is an isometric view of the shunt trip mechanism of FIG. 4 in the off and discharged position with some parts removed to show engagement of the first and second wheels.
Figure 9:
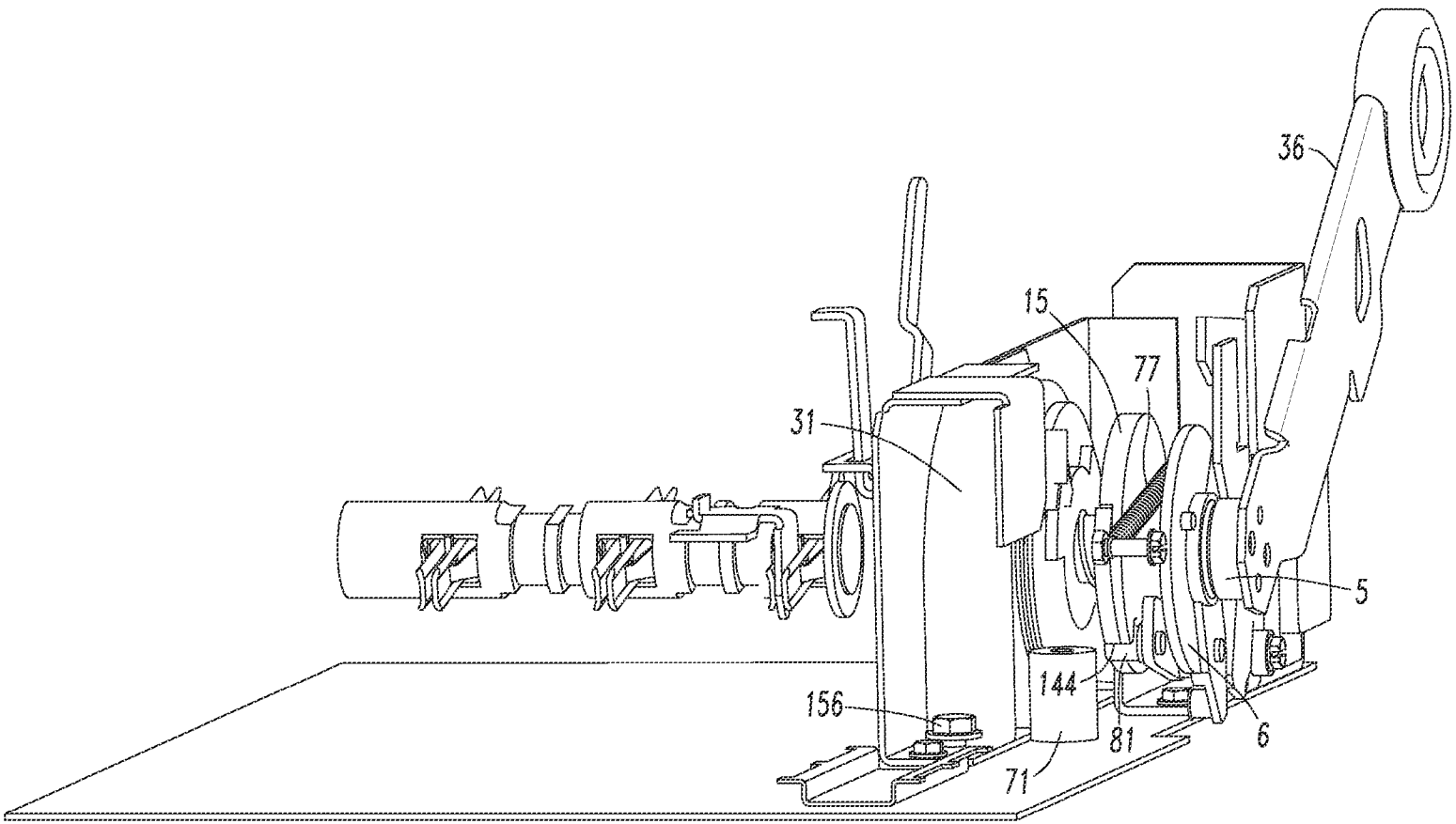
FIG. 9 is an isometric view of the shunt trip mechanism of FIG. 4 in the charged position showing the pawl lever in the engaged position, switch closed.

Wheel one 20, when unlatched by the trip shaft 26, causes counter-clockwise (with respect to FIGS. 4-7) rotation of wheel two 19 to the off position thereof. Wheel two 19, when reset, causes clockwise (with respect to FIGS. 4-7) rotation of wheel one 20 to the latched position thereof. Otherwise, wheel one 20 is in a fixed position when latch arm 130 thereof is latched by the trip shaft 26. Rotation of wheel one 20 is provided by the stored energy in opening spring 31, which is fastened by a fastener 156 (FIGS. 4, 9 and 10) at one end and engages a groove (not shown) of wheel one 20 at the other end. Arms 132 of wheel two 19 engage raised projections 134 of wheel one 20 (as best shown in FIG. 8), allowing the turning force to be conveyed to the hexagonal shaft 8 (FIG. 4), which rotates the manual mechanism coupling 22. As wheel one 20 (when unlatched), wheel two 19, the hexagonal shaft 8, and the manual mechanism coupling 22 rotate counter-clockwise (with respect to FIGS. 4-7) together, the manual operating mechanism 3 is rotated into the off position, thereby opening the main switch assembly 38. The rotation of wheel one 20 is stopped by a bumper arm 136 of wheel one 20 and bumper 71. The operating handle 36 then remains at an intermediate position (FIG. 7) between the on and off position, indicating that the enclosed switch 102 has been electrically tripped.

The trip shaft 26 is rotatably supported by mechanism bracket 13 (FIG. 4) at one end, a cylindrical spring support 32 within trip shaft bracket 9, and a retaining ring 16 and washer 33 forming the joint 148 (FIG. 7) at the other end.

When the main switch assembly 38 is to be closed after an electrical trip, the operator moves the switch operating handle 36 to the "off" (or open) position (FIG. 5) and then to the "on" (or closed) position (FIG. 6). This causes two resetting actions in the shunt trip mechanism 100 by the pin and sleeve bushing 138 at the end 140 of arm 142 of wheel four 6 moving the trip latch lever 10 with surface 10B toward the trigger lever latch 114. With this lever rotation, energy is again stored in the latch shaft drive spring 30 for the next electrical trip operation. The extension spring 76 causes rotation of the pawl lever 75 in turn causing the pawl bushing 81 of pawl bushing shaft 80 to re-engage and re-enter slot 144 in wheel three 15, during the reset rotation of wheel four 6, causing coupling to be restored between wheel three 15 and wheel four 6. The pawl bushing 81 is retained to the pawl bushing shaft 80 by pawl bushing retainer 82. The handle indication extension spring 77 being anchored to wheel four 6 and the pawl lever return spring 76 being anchored to pawl lever 75 causes pawl lever 75 carrying the pawl bushing 81 of pawl bushing shaft 80 to return to the slot 144 of wheel three 15 as it independently pivots with respect to wheel four 6 during the resetting action. When wheel three 15 and wheel four 6 are aligned by stop 158 (shown in FIGS. 4, 5 and 7) while the manual operating handle 36 is at the off position, the pawl extension spring 76 can then draw the pawl bushing 81 into the wheel three 15 slot 144 to restore the coupling.

First, in response to the "off" position, a pin 138 (FIG. 7) (best shown in FIG. 5) at end 140 of arm 142 of wheel four 6 moves (clockwise with respect to FIGS. 4-7) the trip latch lever 10 toward the trigger lever latch 114. With this rotation of the trip latch lever 10, sufficient energy (e.g., without limitation, spring 30 is wound about 180° from its relaxed state) is again stored in the latch shaft drive spring 30 for the next electrical trip operation, and rotation of the pawl lever 75 (FIG. 4), thereby re-engaging wheel four 6 to wheel three 15 with the slot 144 in wheel four 6 being engaged by pawl lever bushing 81. Also, during this first closure operation of the main switch assembly 38 after an electrical trip, the opening spring 31 is recharged simultaneously through the engagement of wheel two 19 and wheel one 20 with the arms 132 and the raised projections 134. This is shown in FIG. 8.

Second, in response to the "on" position, at the closing position of the main switch assembly 38, the latch arm 130 of wheel one 20 touches and rotates the trip shaft 26 (counter-clockwise with respect to FIGS. 4-7) at the section where the flat 128 is at the depth of the center 146 of the trip shaft 26. Rotation of the trip shaft 26 is allowed by joint 148 (FIG. 5) at shaped opening 152 (FIG. 8) of the trip latch lever 10 and a flat end 150 (FIG. 4) of the trip shaft 26, which allows counter-clockwise rotation (with respect to FIGS. 5 and 6) of the trip shaft 26 for the latching function. The flat end 150 of the trip shaft 26 and the shaped opening 152 for the shaft 26 in the trip latch lever 10 allow for the shaft 26 to rotate counter-clockwise during reset of wheel one 20 and then back clockwise with the torque from the trip shaft 26 spring 29 (with respect to FIGS. 5 and 6) to latch and hold wheel one 20 in the latched position.

After a reset and closure operation, for a trip operation, the latch lever 10 can then pivot counter-clockwise (with respect to FIGS. 4-7). As shown in FIG. 8, the trip latch lever 10 is latched and wheel one latch arm 130 is unlatched. After latching of the latch arm 130, tripping operation proceeds as follows. The trigger latch lever 114 releases the trip latch lever 10 to rotate counter-clockwise. The shaped opening 152 in the trip latch lever 10 engages the flat end 150 of the trip shaft 26 and causes the trip shaft 26 to also pivot counter-clockwise (with respect to FIGS. 4-8). This counter-clockwise shaft rotation allows the latch arm 130 of wheel one 20 to pass through center 146 of the trip shaft 26 and the latch arm 130 is released by the flat 128 of the trip shaft 26.

Following a trip operation and until the reset operation is fully completed, wheel three 15 is disengaged from the handle 36 by rotation of the pawl lever 75, removing the pawl bushing 81 from slot 144. Otherwise, the handle 36 is engaged with wheel three 15 and, thus, with the hexagonal shaft 8, wheel two 19, the manual mechanism coupling 22 and the manual operating mechanism 3 for rotation therewith.

During manual operation, the arms 132 of wheel two 19 do not rotate wheel one 20 by virtue of the angular spacing of the raised projections 134. The wheel spring 21 sustains axial contact of wheel two 19 to wheel one 20.

Figure 5:
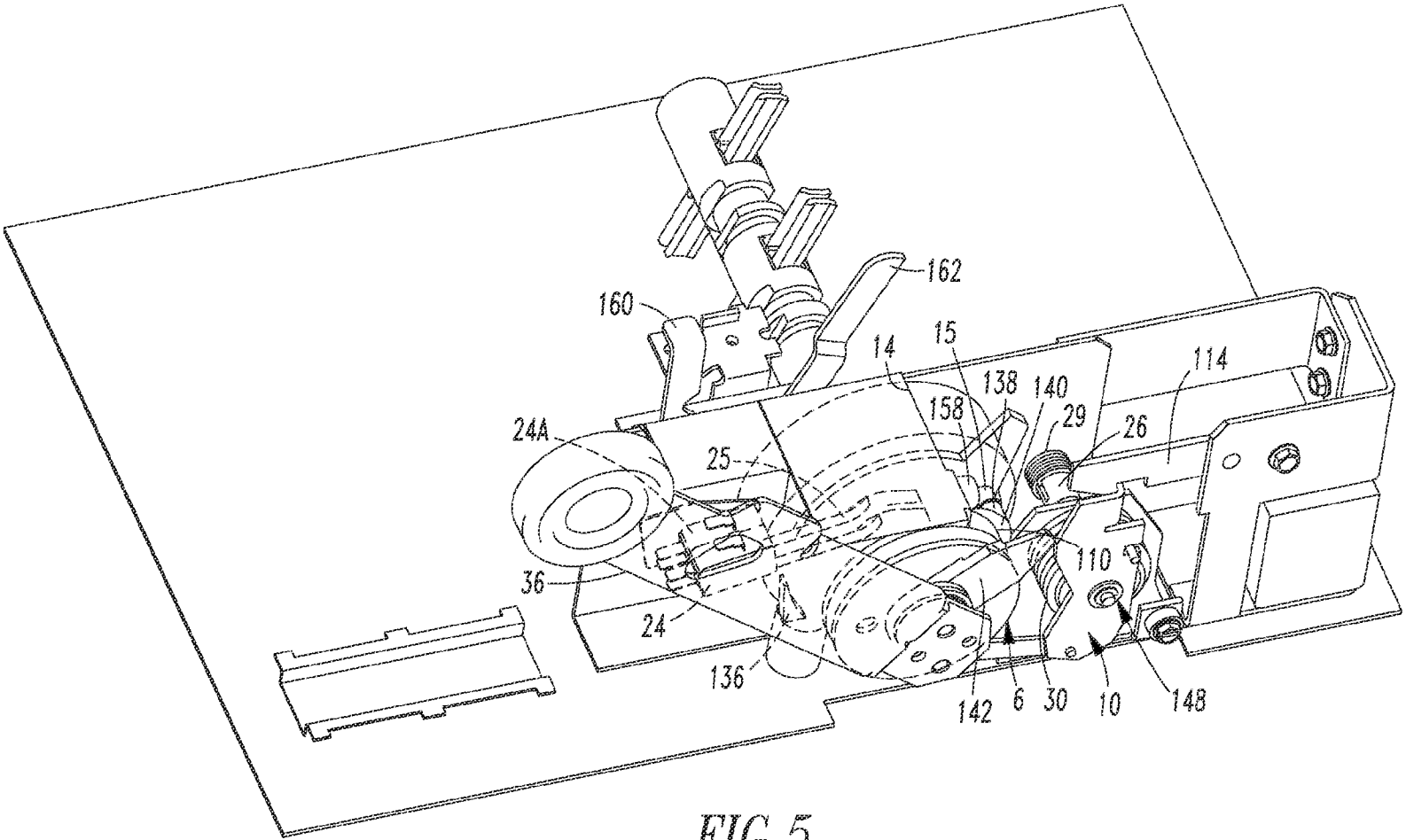
FIG. 5 is an isometric view of the shunt trip mechanism of FIG. 4 in the off position by shunt trip, ready to restore the opening spring to a charged position.

As shown in FIG. 5, counter-clockwise rotation of wheel three 15 is stopped by stop 158 and support bracket 14.

The enclosed switch 102 also includes a door latch 160 and a door interlock 162.

The auxiliary switch 24 of FIG. 4 is used for external signal circuits (not shown).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. An enclosed switch comprising:

a switch assembly comprising separable contacts;

an operating mechanism structured to open and close said separable contacts; and a shunt trip mechanism cooperating with said operating mechanism to trip open said separable contacts, wherein said operating mechanism comprises a manual operating mechanism, wherein said shunt trip mechanism comprises a solenoid including a plunger, a latch, a latch lever and a rotatable trip shaft, wherein energization of said solenoid causes said plunger to move said latch, release said latch lever and cause said rotatable trip shaft to rotate to a trip position, wherein said manual operating mechanism comprises a manual operating handle; wherein said shunt trip mechanism further comprises a pawl lever; wherein said latch lever, when released, causes rotation of said pawl lever to disengage said manual operating handle from said manual operating mechanism; and wherein said manual operating handle moves to an intermediate position between a closed position and an open position thereof in response to release of said latch lever.

2. The enclosed switch of claim 1 wherein said manual operating mechanism comprises a pair of wheels normally coupled together by the pawl lever in one of the wheels and an opening in the other one of the wheels; wherein said manual operating handle is rotatably coupled to said one of the wheels; and wherein rotation of said pawl lever causes said other one of the wheels to decouple from said one of the wheels, thereby allowing said manual operating handle to move to said intermediate position.

3. An enclosed switch comprising:

an enclosure including an exterior side;

a switch assembly within said enclosure, said switch assembly comprising separable contacts;

a side mounted operating mechanism mounted to the exterior side of said enclosure and extending within said enclosure, said side mounted operating mechanism being structured to open and close said separable contacts; and a shunt trip mechanism within said enclosure, said shunt trip mechanism cooperating with said side mounted operating mechanism to trip open said separable contacts, wherein said side mounted operating mechanism comprises a manual operating mechanism, wherein said shunt trip mechanism comprises a solenoid including a plunger, a latch, a latch lever and a rotatable trip shaft, wherein energization of said solenoid causes said plunger to move said latch, release said latch lever and cause said rotatable trip shaft to rotate to a trip position, wherein said operating mechanism further comprises a pair of wheels normally coupled together by a plurality of coupling members of said wheels; wherein a first one of said wheels comprises a latch arm normally held by said trip shaft; wherein rotation of said trip shaft releases the latch arm of the first one of said wheels; and wherein the first one of said wheels is biased to cause rotation of a second one of said wheels to an off position thereof, in order to open said separable contacts.

4. The enclosed switch of claim 3 wherein said pair of wheels is a first pair of wheels; wherein said manual operating mechanism comprises a second pair of wheels normally coupled together by a pawl lever coupling one of the second pair of wheels and an opening in the other one of the second pair of wheels; wherein said manual operating handle is rotatably coupled to said one of the second pair of wheels; wherein said shunt trip mechanism further comprises the pawl lever, a pawl bushing and a pawl bushing shaft; wherein said latch lever, when released, causes rotation of the pawl lever to disengage said manual operating handle from said other one of the second pair of wheels, thereby allowing said manual operating handle to move to said intermediate position.

5. The enclosed switch of claim 3 wherein said operating mechanism further comprises a rotatable shaft and a coupler engaged by the rotatable shaft for rotation therewith; wherein the second one of said wheels is also engaged by the rotatable shaft for rotation therewith; and wherein said coupler engages said switch assembly for rotation therewith.

6. The enclosed switch of claim 5 wherein said operating mechanism further comprises an opening spring engaging and biasing the first one of said wheels.

7. The enclosed switch of claim 3 wherein said latch lever includes a shaped opening; wherein said trip shaft includes an end structured to pivot in said shaped opening and a portion structured to be engaged and pivoted by a portion of said shaped opening; wherein after said release of said latch lever, which causes said trip shaft to rotate to the trip position, the portion of said shaped opening engages the portion of said trip shaft and causes said rotatable trip shaft to pivot and release the latch arm of the first one of said wheels.

8. The enclosed switch of claim 7 wherein during a reset operation, the second one of said wheels causes rotation of the first one of said wheels to a latched position where the latch arm is held by said trip shaft.

9. The enclosed switch of claim 8 wherein during said reset operation, a manual operating handle is first rotated to an off position and then is rotated to an on position.

10. The enclosed switch of claim 9 wherein said pair of wheels is a first pair of wheels; wherein said manual operating mechanism comprises a second pair of wheels normally coupled together by a lever in one of the second pair of wheels and an opening in the other one of the second pair of wheels; wherein said manual operating handle is rotatably coupled to said one of the second pair of wheels; wherein when said manual operating handle is first rotated to the off position, a member of an arm of said one of the second pair of wheels moves the latch lever toward said latch; and wherein rotation of the latch lever stores energy in a spring for a subsequent trip operation and causes engagement of the pawl lever of said one of the second pair of wheels with the opening in the other one of the second pair of wheels.

11. The enclosed switch of claim 10 wherein during rotation of said manual operating handle to the on position, an opening spring is recharged by engagement of the first pair of wheels; wherein at the closing position of the switch assembly, the latch arm of the first one of the first pair of wheels touches and rotates the trip shaft; and wherein the end structured to pivot in said shaped opening and the portion structured to be engaged and pivoted by the portion of said shaped opening allow for the trip shaft to rotate during said reset operation and then back to latch and hold the first one of the first pair of wheels in the latched position.

12. An enclosed switch comprising:

a switch assembly comprising separable contacts;

an operating mechanism structured to open and close said separable contacts; and a shunt trip mechanism cooperating with said operating mechanism to trip open said separable contacts, wherein said operating mechanism comprises a manual operating mechanism, wherein said shunt trip mechanism comprises a trip shaft;

wherein said operating mechanism comprises a first pair of wheels normally coupled together by a plurality of coupling members of said wheels; wherein a first one of the first pair of wheels comprises a latch arm normally held by said trip shaft; wherein rotation of said trip shaft releases the latch arm of the first one of the first pair of wheels; wherein the first one of the first pair of wheels is biased to cause rotation of a second one of the first pair of wheels to an off position thereof, in order to open said separable contacts; wherein said manual operating mechanism comprises a second pair of wheels normally coupled together by a pawl lever coupled to one of the second pair of wheels and an opening in the other one of the second pair of wheels; wherein said manual operating handle is rotatably coupled to said one of the second pair of wheels; wherein said shunt trip mechanism further comprises the pawl lever to disengage said manual operating handle from said manual operating mechanism; wherein said manual operating handle moves to an intermediate position between a closed position and an open position thereof in response to said pawl lever rotation causing the other one of the second pair of wheels to decouple from said one of the second pair of wheels, thereby allowing said manual operating handle to move to said intermediate position.

13. The enclosed switch of claim 12 wherein said shunt trip mechanism comprises a solenoid and a switch mechanism cooperating with the other one of the second pair of wheels; wherein said switch mechanism is structured to enable said solenoid when said manual operating mechanism is in a closed position and to disable said solenoid when said manual operating mechanism is in an open position.

14. The enclosed switch of claim 12 wherein said operating mechanism further comprises a rotatable shaft and a coupler engaged by the rotatable shaft for rotation therewith; wherein the second one of said first pair of wheels and the other one of said second pair of wheels are also engaged by the rotatable shaft for rotation therewith; and wherein said coupler engages said switch assembly for rotation therewith.

15. The enclosed switch of claim 14 wherein said operating mechanism further comprises a spring disposed on said rotatable shaft and biasing the second one of said first pair of wheels toward the other one of said second pair of wheels, and biasing the other one of said second pair of wheels toward said one of said second pair of wheels.

16. The enclosed switch of claim 15 wherein during manual operation, the second one of said first pair of wheels rotates independent of the other one of said second pair of wheels, and said one of said second pair of wheels is coupled to and rotates with the other one of said second pair of wheels.

* * * * *